United States Patent [19]

Vick

[11] Patent Number: 4,854,222

[45] Date of Patent: Aug. 8, 1989

[54] LOAD COMPENSATED SERVO SYSTEM TO CONTROL FLOW RATE AS A FUNCTION OF COMMAND

[75] Inventor: Ralph L. Vick, Granada Hills, Calif.

[73] Assignee: Allied-Signal Inc., Morris Township, Morris County, N.J.

[21] Appl. No.: 234,979

[22] Filed: Aug. 22, 1988

[51] Int. Cl.[4] ..... F15B 13/043

[52] U.S. Cl. ..... 91/447; 91/461; 137/596

[58] Field of Search ..... 91/447, 461; 137/596

[56] References Cited

U.S. PATENT DOCUMENTS

| | | | |
|---|---|---|---|
| Re. 29,329 | 8/1977 | Walters | 137/596 X |
| 3,410,306 | 11/1968 | Malott | 91/447 X |
| 3,896,852 | 7/1975 | Holmes | 91/461 X |
| 3,899,001 | 8/1975 | Orme | 137/625.3 |
| 3,978,891 | 9/1976 | Vick | 137/625.3 X |

*Primary Examiner*—Gerald A. Michalsky

*Attorney, Agent, or Firm*—Robert C. Smith

[57] ABSTRACT

A hydraulic servo system to control flow rate of working fluid to a hydraulic motor as a function of command includes a spool-type pilot valve with manual or electrohydraulic structure for positioning the pilot valve and control conduits connecting the pilot valve to a flow control valve having lands and chambers between the lands for directing flow to the hydraulic motor, the flow control valve having a cylindrical cavity at one end and being exposed to full system pressure at the other end, a shuttle valve coaxially positioned with respect to the flow control valve having an axial extension extending into the cylindrical cavity, a spring in the cavity which tends to urge the flow control valve in a direction to oppose the system pressure, with control passages connecting opposite sides of the shuttle valve with the flow control valve chambers causing the shuttle valve to select the higher pressure in the flow control valve chambers and causing the spool to seek a position providing the desired flow rate.

10 Claims, 1 Drawing Sheet

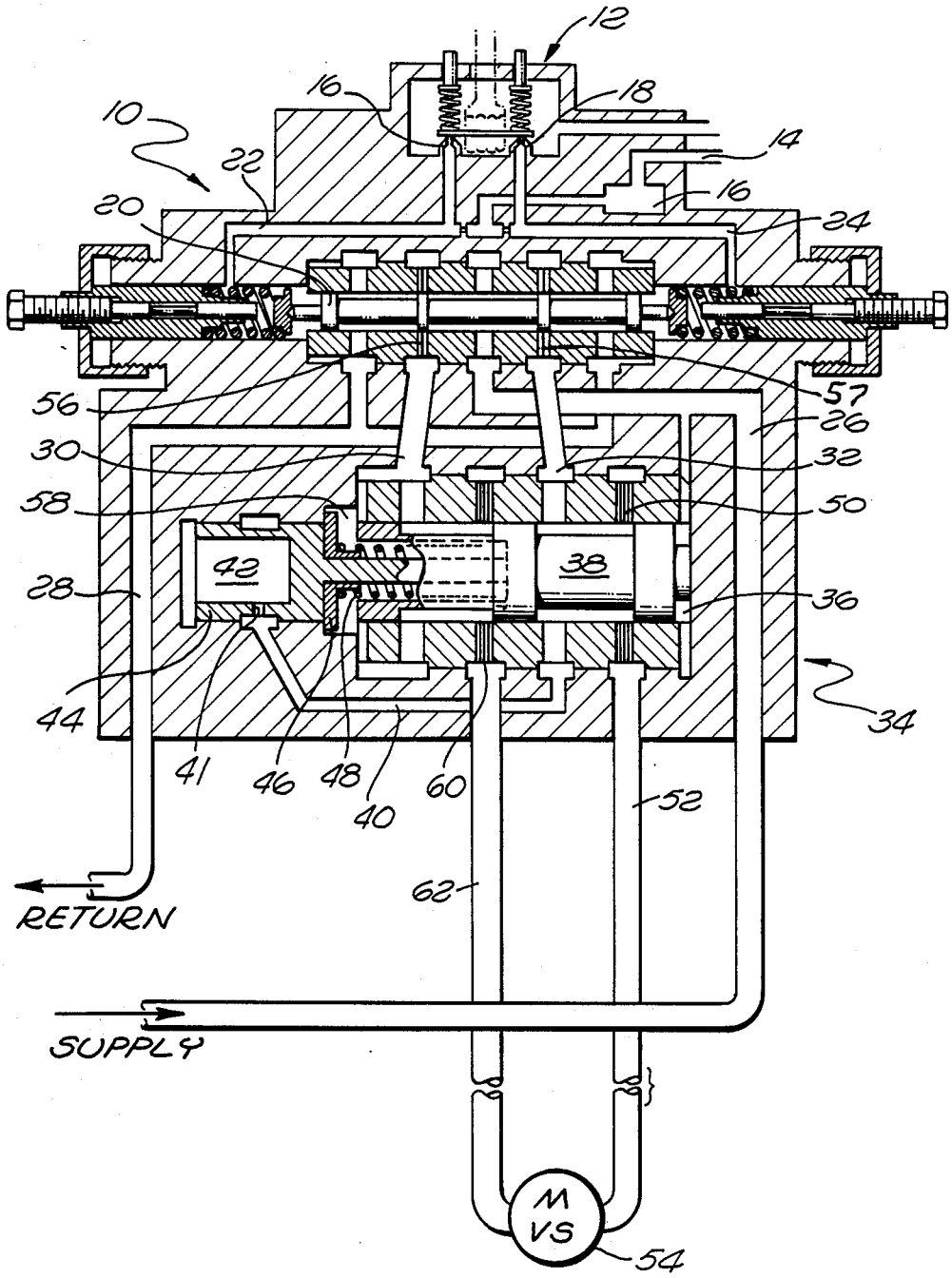
12
16
18
10
14
22
16
20
24
56
57
26
30
32
58
50
42
38
28
36
44
34
41
46
48
60
40
52
62
RETURN
SUPPLY
M
VS
54

LOAD COMPENSATED SERVO SYSTEM TO CONTROL FLOW RATE AS A FUNCTION OF COMMAND

This invention relates to a hydraulic servo system which will control flow rate as a function of command.

The usual hydraulic servo system incorporates either a mechanical input means to a spool valve or an electrohydraulic first stage having a torque motor which responds to an electrical command to control the pressure differential across the spool valve to position the spool valve relative to ports connected to conduits communicating with a high pressure source, a return pressure source, and control conduits which direct the controlled pressure to a second stage spool valve controlling an external utilization device such as an actuator. Such a system will typically cause an actuator, for example, to maintain a position despite varying loads and also will move the actuator to a new position as a function of a changed electrical request signal despite varying loads.

SUMMARY OF THE INVENTION

There are certain applications wherein it is desired that the servovalve control actuator velocity, cable payout rate, etc. (depending upon the system) as a function of command but regardless of load—providing the load is within system pressure control limits. Applicant has devised a system in which the servovalve (manual or electrohydraulic control) provides the control orifice for a downstream flow control valve as a function of command. The control orifice area is variable as a function of command and replaces the normal fixed orifice in a flow control valve which sets the valve for a specific flow regardless of load. The variable orifice area is variable as a function of command and since the flow value is a function of the orifice area, flow is also a function of command.

The load compensated servovalve of the present invention includes the components described above with some additions. A shuttle valve selector is mounted to the side of the flow control valve. This valve will sense and select the pressurized cylinder port and, through a pilot line, direct this pressure to the spring side of the flow control valve. Another line connects the high pressure source to the pressure control end of the flow control valve. In this manner the pressure drop across the sleeve of the flow control valve is sensed as accurately as possible by picking up pressures adjacent to the high pressure and cylinder (or motor) sides of the metering area. This pressure drop will vary as the output load varies and the servo system will continue to supply the requested flow despite variations in load so long as the pressure variations are within the pressure limits of the system. Maximum flow is limited by the full open condition of the flow controlling valve. When this valve is at null, no flow will occur.

DESCRIPTION OF THE DRAWINGS

The single figure is a schematic drawing of a hydraulic servo system incorporating my invention.

DESCRIPTION OF THE PREFERRED EMBODIMENT

Referring now to the drawing, the housing 10 includes as a first stage, an electrohydraulic servovalve 12 which is conventional and which receives electrical request signals from a controller (not shown) which requests a desired flow at the system output. Servovalve 12 receives hydraulic fluid under pressure from a line 14 containing a filter 16 and moves to vary the effective area of ports 16 and 18 to thereby control through lines 22 and 24 the pressures acting on the end lands of second stage spool valve 20. In the absence of a signal on electrohydaulic servovalve 12, the pressures across spool 20 will be balanced to position the center two lands of spool valve 20 to block flow thereacross. When a change in command occurs, spool valve 20 will be moved to a new position commensurate with a desired flow, and will then be stabilized at this position.

Spool valve 20 is in communication with a high pressure source through a conduit 26, with system return pressure through a conduit 28; and with control pressure conduits 30 and 32 which communicate with a flow control valve 34 through quieting disk sets 56 and 57. High pressure conduit 26 also communicates with a chamber 36 at the right end of a spool 38 forming part of valve 34. Control conduit 32 communicates with a chamber between the center and right hand lands of spool 38 and also through a passage 40 with an orifice 41 which communicates with a chamber 42 on the left side of a shuttle valve member 44. Valve member 44 abuts against a spring retainer member 46 which secures a spring 48 between itself and a retaining surface within the hollow interior of spool 38. With spool 38 in the position shown, the fluid pressure between the center and right hand lands of spool 38 also communicates with a series of quieting disks 50 which deliver hydraulic fluid at this controlled pressure through an outlet conduit 52 to a variable speed hydraulic motor 54, which flow drives motor 54 in a first direction. At the same time fluid leaves motor 54 through a conduit 62, crosses quieting disk set 60, the left control chamber of valve 34, flows through conduit 30, disk set 56, spool valve 20 and into return pressure conduit 28.

Disk sets 50 and 60 are quieting variable restriction paths in series with the flow control valve 34 and the hydraulic motor 54 or other actuator. These disk sets absorb the load pressure losses as needed to maintain the desired flow. Disk sets 56 and 57 are low pressure controlled variable restrictions also in series forming the controlled variable orifice.

If spool valve 20 is positioned slightly to the left of the position shown, it will direct hydraulic fluid under system pressure to quieting disks 56 and through these disks to control pressure conduit 30 and into a chamber between the center and left hand lands of flow control valve 34. This chamber also communicates with a chamber 58 at the left end of flow control valve 34 and through a set of quieting disks 60 with conduit 62 connected with motor 54. The quieting disks comprise sets of disks of small thickness (0.005–0.010 in.) having edge openings to the direction of flow and which define a series of orifices and narrow paths providing substantial pressure drop across the disks. Similar disk sets are described in my U.S. Patent No. 3,978,891. At this time spool valve 20 will also open communication between control conduit 32 and the low or return pressure conduit 28 which substantially reduces pressure in control conduit 32, the chamber between the center and right hand lands of spool 38, and in chamber 42 because of the motor return flow metering through disk set 50. This effectively removes piston 44 from producing any effect on the position of spool 38, which will seek a position balanced between supply pressure in chamber 36 urging spool 38 toward the left and the control pressure in chamber 58 plus the force of spring 48 urging spool 38 toward the right. With the high control pressure directed to line 62 and line 52 connected effectively to a much lower control pressure in conduit 32, varible speed motor 54 will be driven in a second direction opposite to that described above.

It is the function of the control to provide such flow to motor 54 that the requested rotational rate will be maintained despite changes in loading. Once a given flow rate through motor 54 is established from the initial positioning of pilot valve 20, the flow control valve 34 and shuttle valve 44 operate to maintain the flow. For example, let us assume that flow at a desired rate through motor 54 is stabilized with flow proceeding from conduit 52 through the motor 54 to conduit 62. A subsequent increase in load will tend to cause motor 54 to slow down which will be reflected in a lower pressure in chamber 58 acting against the left end of spool 38. The pressure in chamber 42 will then tend to move spool 38 toward the right, increasing the effective area thorugh disk sets 50 and 60 and increasing the flow through conduit 52 to motor 54 to cause it to maintain speed. Should a decrease in load tend to cause motor 54 to increase speed, the pressure in line 52 will drop, resulting in a lower pressure in chamber 42. At this time the greater pressure in chamber 58 will move shuttle valve 44 to the left and permitting spool 38 to move to the left also under the urging of system pressure acting on its right end. Operation is analogous if flow through motor 54 is in the opposite direction.

From the foregoing it will be seen that the flow control valve 34 will always be exposed to the difference between the system pressure and whichever control pressure is requested at the pilot valve or servovalve 12. The pressure drop across the flow control valve 34 will vary with load and the system will continue to supply the requested flow so long as system pressure requirements are not exceeded.

I claim:

1. A hydraulic servo system to control flow rate as a function of an input command including a spool-type pilot valve and input means controlling said pilot valve, a spool-type flow control valve having a plurality of lands connected to said pilot valve, a motor and first and second conduits connecting said motor to said flow control valve, a third conduit connected to a source of fluid under high system pressure, to one end of said flow control valve to urge said flow control valve in a first direction, and to said pilot valve;

a fourth conduit connecting said pilot valve with a low pressure source;

fifth and sixth conduits connecting said pilot valve with chambers between lands of said flow control valve:

characterized in that said system includes a shuttle valve member including an extension capable of urging said flow control valve in a direction opposite to the direction it is urged by said high system pressure, a chamber on the side of said shuttle valve member opposite said extension and first passage means connecting said shuttle valve chamber with said fifth conduit, resilient means located between said shuttle valve and said flow control valve, and second passage means connecting said sixth conduit with the opposite end of said flow control valve whereby said flow control valve is exposed to the difference between system pressure and the control pressure requested by said pilot valve.

2. A hydraulic servo system as claimed in claim 1 wherein said pilot valve has ports connected to said fifth and sixth conduits and quieting disks are located in said ports.

3. A hydraulic servo system as claimed in claim 2 wherein said flow control valve includes a sleeve and a member movable within said sleeve, said sleeve has ports connecting said valve member with said first and second conduits and quieting disks are in said ports.

4. A hydraulic servo system as claimed in claim 1 wherein said input means is a first stage electrohydraulic servovalve.

5. A hydraulic servo system as claimed in claim 1 wherein said shuttle valve includes a bleed connecting said chamber in said shuttle valve member with said first passage means.

6. A hydraulic servo system as claimed in claim 1 wherein said spool includes a cylindrical cavity at said opposite end, and said resilient means comprises a spring in said cavity.

7. A hydraulic servo system as claimed in claim 6 wherein a spring retainer is supported on said extension of the shuttle and said spring surrounds said shuttle valve extension.

8. A hydraulic servo system as claimed in claim 6 wherein said spring provides a force acting in addition to the pressure in said shuttle valve chamber to oppose said system pressure across said flow control valve.

9. A hydraulic servo system to control flow rate as a function of command including a spool-type pilot valve and input means positioning said spool-type pilot valve, a system pressure conduit, a return pressure conduit and first and second control pressure conduits connected to said spool-type pilot valve;

a flow control valve connected to said spool type pilot valve, said flow control valve including a spool having a cylindrical cavity at one end and having lands, first and second control chambers between said lands, said first and second control pressure conduits being connected to said first and second control chambers;

a hydraulic motor and first and second passageways connecting said first and second control chambers to said passageways;

characterized in that said system includes a shuttle valve member and an axial extension thereof extending into said cylindrical cavity operatively connecting said shuttle valve member to one end of said spool, a passage connecting the opposite end of said spool with said system pressure conduit, a second passage connecting one of said control chambers with one side of said shuttle valve;

a third passage connecting the other said control chamber with the opposite side of said shuttle valve;

and a spring in said cylindrical cavity cooperating with said axial extension, whereby said shuttle valve operates to select the higher pressure in said flow control chambers which is added to the force of said spring across said spool in opposition to said system pressure and causing said spool to seek a position to provide the desired flow rate.

10. A hydraulic servo system as claimed in claim 9 wherein a spring retainer is supported on said axial extension and said spring surrounds said extension and tends to urge said spool in a direction to oppose the force of system pressure acting against said opposite end of said spool.

* * * * *